US005853085A

United States Patent [19]

Luttrell

[11] Patent Number: 5,853,085

[45] Date of Patent: Dec. 29, 1998

[54] DISPOSABLE APPARATUS FOR CONTAINING AND CLEANING CONTACT LENSES

[76] Inventor: Mark Luttrell, 161 N. Rose Rd., Memphis, Tenn. 38119

[21] Appl. No.: 964,255

[22] Filed: Nov. 4, 1997

[51] Int. Cl.[6] ..... A45C 11/04

[52] U.S. Cl. ..... 206/5.1; 206/219; 383/38

[58] Field of Search ..... 206/5.1, 219, 221; 134/901; 383/38, 40

[56] References Cited

U.S. PATENT DOCUMENTS

| | | | |
|---|---|---|---|
| 3,369,656 | 2/1968 | Skinner, Jr. | 206/5.1 |
| 4,462,224 | 7/1984 | Dunshee et al. | 206/219 |
| 4,721,124 | 1/1988 | Tuerkheimer et al. | 206/5.1 |
| 5,127,517 | 7/1992 | Clements et al. | 206/5.1 |
| 5,346,061 | 9/1994 | Newman et al. | 206/221 |
| 5,492,219 | 2/1996 | Stupar | 206/219 |
| 5,598,919 | 2/1997 | Taylor | 206/5.1 |

*Primary Examiner*—David T. Fidel

*Attorney, Agent, or Firm*—Todd B. Murrah

[57] ABSTRACT

A hermetically sealable envelope having an open end for containing one or more contact lenses. The envelope is divided into one or more lens containing compartments and one or more fluid containing compartments. One or more ports are formed by the envelope to facilitate communication between each of the one or more fluid containing compartments and selected one or more of the lens containing compartments. One or more flexible balloons, having a quantity of lens care solution contained therein, are encased within the one or more fluid containing compartments. The contact lenses to be cleaned are placed in selected ones of the contact lens containing compartments which are thereafter hermetically sealed by closing a tongue and groove closure defining an upper end of the flexible envelope. After sealing the contact lenses within the envelope, manual pressure is exerted against the selected ones of the one or more balloons to burst the selected balloons and thereby dispense the lens care solution contained therein through the ports and within the lens containing compartments to treat and clean the contact lenses contained therein.

19 Claims, 3 Drawing Sheets

Fig. 3
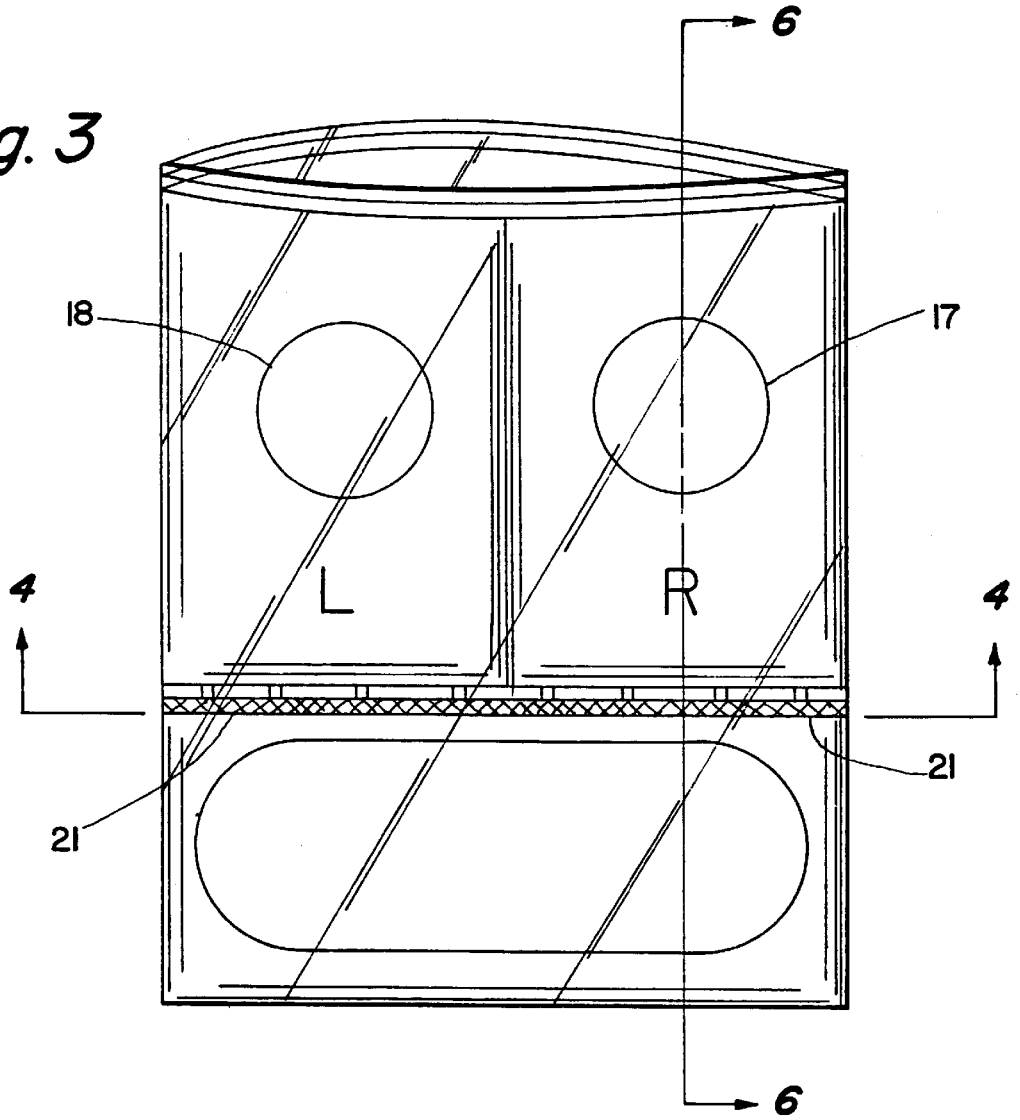
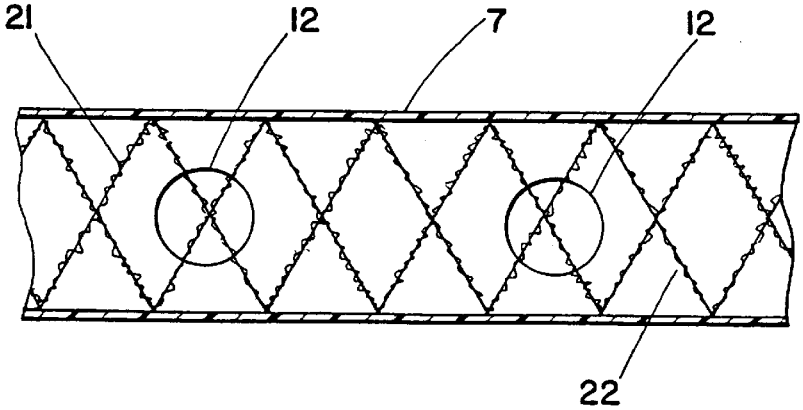
Fig. 4

DISPOSABLE APPARATUS FOR CONTAINING AND CLEANING CONTACT LENSES

FIELD OF THE INVENTION

The present invention relates to apparatus for containing contact lenses in a liquid lens care solution. More particularly, the present invention relates to flexible, disposable and transparent apparatus for containing contact lenses in a liquid lens care solution wherein the liquid lens care solution is permanently contained in the apparatus for a one time use. In even greater particularity, the present invention relates to such containing apparatus wherein the contact lenses are contained in compartments separate from the liquid lens care solution, such that the liquid lens care solution is selectively injected into the compartment after the contact lenses are received and hermetically isolated therein.

BACKGROUND OF THE INVENTION

It is commonly known that optical contact lenses must be periodically cleaned and moisturized to facilitate optimum performance when applied to the human cornea. A variety of cleaning and moisturizing solutions are also known. Commonly each contact lens is placed in a separate rigid container wherein a volume of lens care solution has been deposited from a larger separate container of lens care solution. A need exists, however, for a easily portable and disposable lens care apparatus for use by persons who are traveling. When traveling, it can be overly cumbersome to carry the larger volume of lens care solutions and separate lens containers. Also, unexpected overnight stays may leave a contact lens user without solution or containers for caring for his or her contact lenses. This dilemma requires the user to purchase an additional large quantity of cleaning solution and additional containers.

What is needed is a disposable contact lens container having a quantity of lens care solution therein which is maintained in a sterile environment. U.S. Pat. No. 5,054,610 issued to Ajello on Oct. 8, 1991, discloses a disposable single use contact lens conditioning package having a plurality of shallow trays which contain a small quantity of lens care solutions therein. The solution is contained in the trays by a polyurethane film adhesively connect to the trays. To use the lens conditioning package described in U.S. Pat. No. 5,054,610, the film is pulled from the tray and the lenses are placed in the solution for overnight conditioning. Though simple and efficient in its use, the lens conditioning package described in U.S. Pat. No. 5,054,610 requires some dexterity by the user for proper use. The removal of the film from the tray, placement of the contact lenses within the tray and stirring of the contact conditioning solution with the spoon provided can result in inadvertent spillage of the solution and accidental loss of the contact lenses.

SUMMARY OF THE INVENTION

The principal object of the present invention is to provide a disposable, single-use contact lens cleaning and care apparatus that contains the contact lenses and the lens care solution in a hermetically sealed environment.

In support of the principal object, another object of the present invention is to provide a disposable, single-use contact lens cleaning and care apparatus wherein the contact lens care solution is contained in a sterilized hermetically sealed envelope which temporarily isolates the lens care solution until such time that the contact lenses are placed within a containment portion of the invention and are hermetically sealed therein.

Another object of the present invention is to provide a disposable, single-use contact lens cleaning and care apparatus which facilitates a selective combination, subsequent to the placement of the lenses within the containment portion, of two or more chemical agents which an oxidizing agent for disinfecting the contact lenses.

These and other objects and advantages of the present invention are accomplished through the use of a flexible, hermetically sealable envelope having an open end for containing one or more contact lenses. The envelope is divided into one or more lens containing compartments and one or more fluid containing compartments. One or more ports are formed by the envelope to facilitate communication between each of the one or more fluid containing compartments and a selected one or more of the lens containing compartments. One or more flexible balloons, having a quantity of lens care solution contained therein, are encased within the one or more of the fluid containing compartments.

The contact lenses to be cleaned are placed in selected ones of the contact lens containing compartments which are thereafter hermetically sealed by closing a tongue and groove closure defining an upper end of the flexible envelope. After sealing the contact lenses within the envelope, manual pressure is exerted against the selected ones of the one or more balloons to burst the selected balloons and thereby dispense the lens care solution contained therein through the ports and within the lens containing compartments to treat and clean the contact lenses contained therein.

A platinum black catalyst filament is contained in each of the one or more fluid containing compartments to chemically react with the lens care solution to generate oxygen which enhances the cleaning ability of the lens care solution.

BRIEF DESCRIPTION OF THE DRAWINGS

Apparatus embodying features of the invention are depicted in the accompanying drawings which form a portion of this disclosure and wherein:

FIG. 3 is a front elevational view of the third embodiment of the present invention.

FIG. 4 is a broken partial sectional view taken along lines 4—4 of the third embodiment of the present invention.

DESCRIPTION OF A PREFERRED EMBODIMENT

Figure 1:
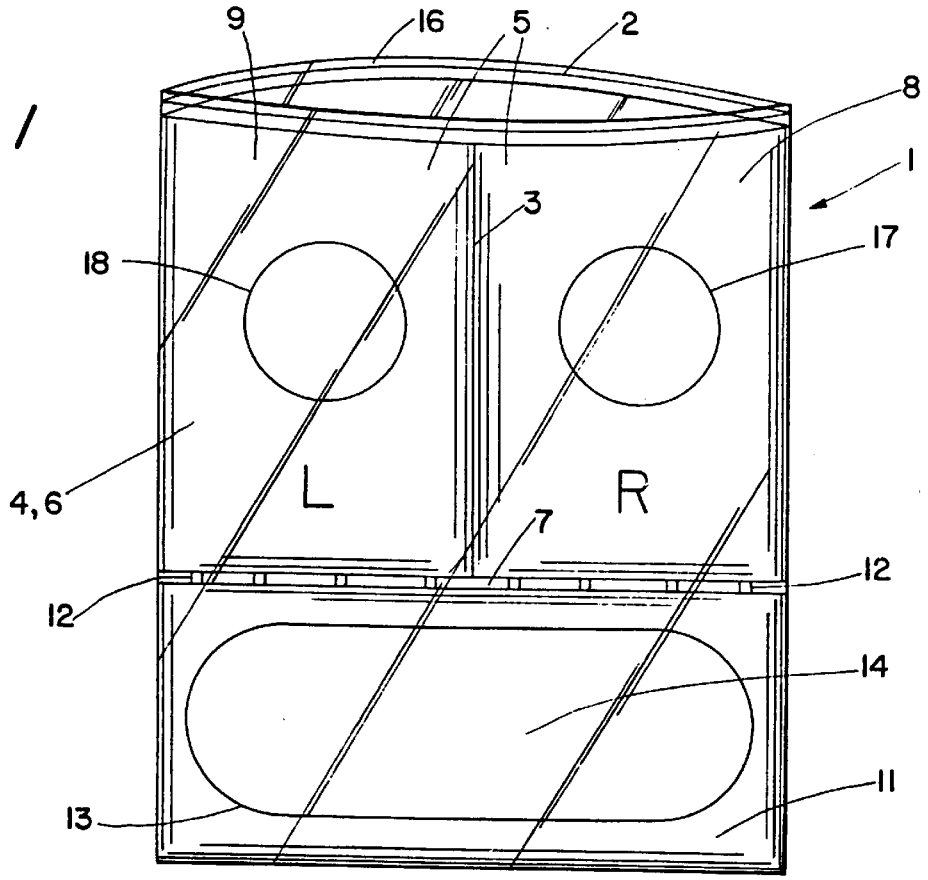
FIG. 1 is a front elevational view of the first embodiment of the present invention.
Figure 5:
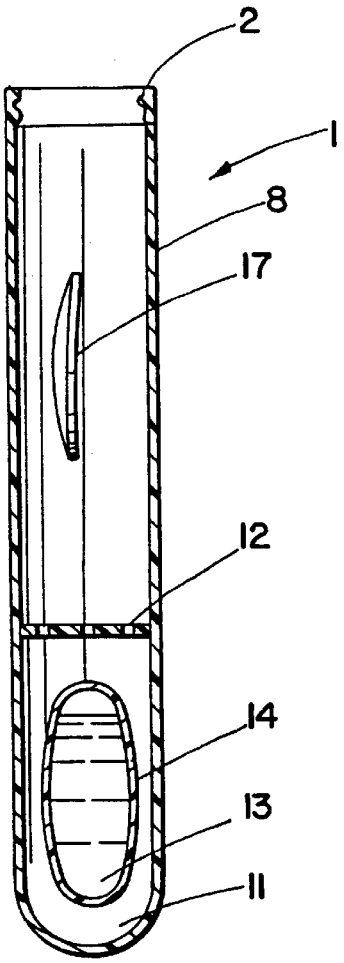
FIG. 5 is a sectional view taken along line 5—5 of FIG. 1 of the present invention.

Referring to the drawings for a clearer understanding of the invention, it should be noted in FIGS. 1 and 5 that a first embodiment of the present invention contemplates the use of a flexible hermetically sealable envelope 1 constructed of a transparent polyeurethane and having an open end 2. The envelope 1 is divided by a vertical seam 3 formed by heat bonding a first side 4 of the envelope 1 to a second side 6 of the envelope 1. The vertical seam extends perpendicularly from the open end 2 a predetermined distance therefrom. The envelope 1 is further divided by a horizontal seam 7 formed by heat bonding the first side 4 to the second side 6 along a line extending perpendicularly to the vertical seam 3 and therethrough at a point opposite the open end 2.

The envelope 1, and horizontal seam 7 form a lens envelope 5 which is divided by the vertical seam 3 into a right lens containing compartment 8, and a left lens containing compartment 9. The horizontal seam 7 also forms a fluid containing compartment or envelope 11. A plurality of ports 12 are formed by and extend through the horizontal seam 7 to facilitate communication between the fluid containing compartment 11 and the right and left lens containing compartments 8 and 9, respectively.

A transparent hermetically sealed polyeurothane balloon 13 containing a lens care solution 14 is contained within the fluid containing compartment 11. The transparent polyeurothane forming the envelope 1 and balloon 13 accommodate sterilization of the lens care solution 14 and the interior of the envelope 1 from sources external of the envelope 1 such as infra-red light and heat transfer sources. The lens care solution 14 can be any of the cleaning, moisturizing or other lens treatment solutions commonly sold on the market including but not limited to sterile water, hydrogen peroxide, saline or buffered isotonic solutions containing sodium chloride, sodium biphosphate, sodium phosphate or benzalkonium chloride. A flexible tongue and groove closure 16 is connected to the open end 2 for selectively opening and hermetically sealing the envelope 1.

In operation, a right contact lens 17 is placed in the right contact lens containing compartment 8. A left contact lens 18 is placed in the left contact containing compartment 9. Right and left indicia 19 and 21, respectively, are formed on the envelope 1 to distinguish the left and right lens containing compartments 8 and 9.

After the right and left contact lenses 17 and 18 are placed in the right and left contact lens containing compartments 8 and 9, respectively, the tongue and groove closure is closed to hermetically seal the contact lenses 17 and 18 within the envelope 1. Manual pressure is applied inwardly to the envelope 1 proximate the balloon 13 until the balloon 13 bursts. The lens solution 14 is thereby released from the balloon 13, dispersed within the fluid containing compartment 11, through the ports 12, into the right and left lens containing compartments 8 and 9, and in contact with the right and left contact lenses 17 and 18. This process is further assisted by turning the lens containing compartments 8 and 9 below the fluid containing compartment 11 such that the lens care solution 14 will gravitate within the lens containing compartments 8 and 9.

To remove the contact lenses 17 and 18 after cleaning, the envelope 1 is turned to an upright position such that the lens care solution 14 will gravitate within the fluid containing compartment 11. The tongue and groove closure 16 is opened and the contact lenses 17 and 18 are removed from the envelope 1. The tongue and groove closure 16 is then closed to contain the used lens care solution 14 for easy disposal.

Figure 2:
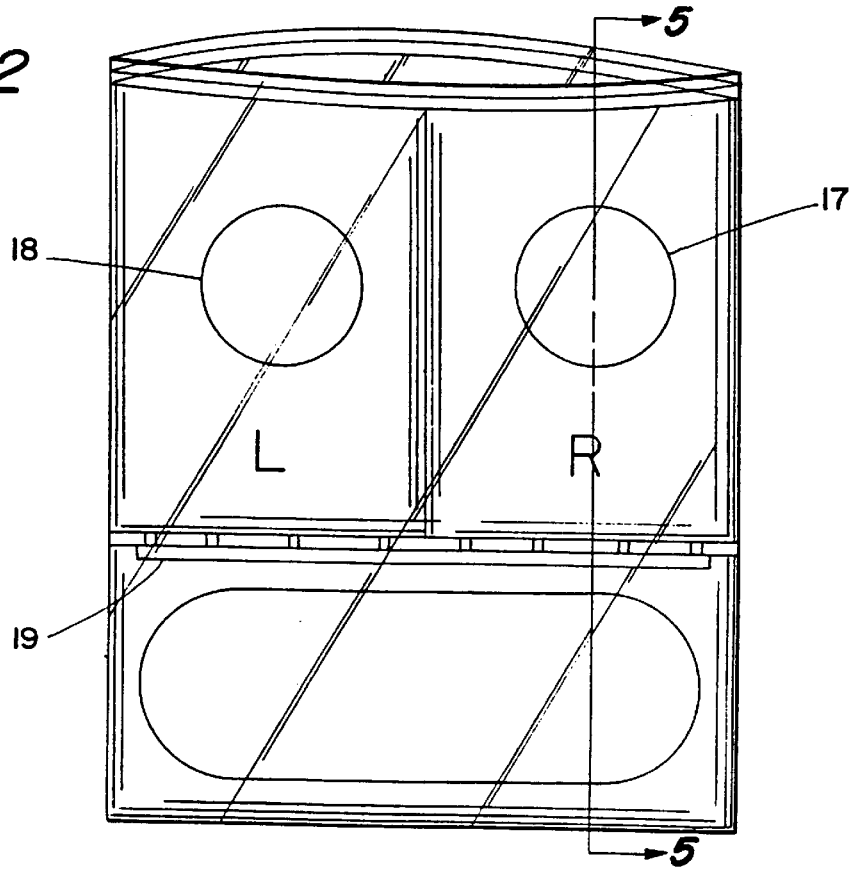
FIG. 2 is a front elevational view of the second embodiment of the present invention.
Figure 6:
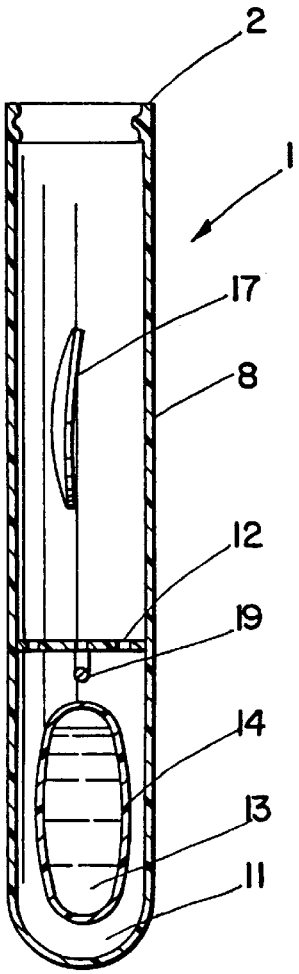
FIG. 6 is a sectional view taken along line 6—6 of FIG. 2.

A second embodiment of the present invention is shown in FIGS. 2 and 6 and includes every component previously described in the first embodiment. In addition, the second embodiment of the present invention includes at least one reactive filament 19 preferably composed of a platinum black catalyst [client to fill in interaction of platinum black catalyst with selected cleaning solution elements]. When the balloon 13 is burst, the lens care solution 14 will contact the reactive filament 19 and react therewith forming an oxidized emulsion prior to passage of the lens care solution 14 within the lens containing compartments 8 and 9 and in contact with the contact lenses 17 and 18 contained therein.

A third embodiment of the present invention is shown in FIGS. 3 and 4 and includes every component previously described in the first embodiment. In addition, the third embodiment of the present invention includes a screen 21 connected to said envelope 1 within the fluid containing compartment 11 and adjacent to the ports 12 for preventing debris (not shown), having a predetermined minimal granular size, from passing from the fluid containing compartment 11 through ports 12 to the lens containing compartments 8 and 9. A granular reactive agent 22, preferably platinum black catalyst, is connected to the screen 21 on a side thereof opposite the ports 12, such that dispersal of the lens care solution 14 from the balloon 13 will contact the reactive agent prior to passing through the ports 12 and into the lens containing compartments 8 and 9. By dispersing the reactive agent 22 along the screen 21, the reactive agent 22 presents a maximum contact surface which is maintained in close proximity to the ports 12 to insure contact between the reactive agent and a maximum volume percentage of the lens care solution 14. The screen 21 also contains the granular reactive agent 22 within the fluid containing compartment 11. From the foregoing, it should be clear that the present apparatus represents a substantial improvement over the prior art.

While I have shown my invention in several forms, it will be obvious to those skilled in the art that it is not so limited but is susceptible of various changes and modifications without departing from the spirit thereof.

What I claim is:

1. A disposable contact lens containing and cleaning apparatus comprising:

(a) a flexible hermetically sealable envelope having an open end for containing one or more contact lenses;

(b) divider connected to said envelope for dividing said envelope into one or more lens containing compartments and one or more fluid containing compartments;

(c) one or more ports formed by said divider for facilitating communication between each of said one or more fluid containing compartments and a selected one or more of said lens containing compartments; and (d) one or more flexible balloons enclosed within selected ones of said fluid containing compartments for containing a selected lens care solution such that manual pressure exerted on said flexible envelope proximate selected ones of said one or more balloons will burst said one or more balloons and facilitate a selected dispersal of said lens care solution into selected ones of said lens containing compartments.

2. An apparatus as described in claim 1 wherein said envelope comprises a substantially transparent polyurethane.

3. An apparatus as described in claim 1, wherein said divider comprises one or more seams formed by bonding a first side of said flexible envelope to a second side of said flexible envelope along one or more predetermined lines.

4. An apparatus as described in claim 1 further comprising one or more screens connected to said envelope within said one or more fluid containing compartments and adjacent to said ports for preventing debris having a predetermined granular size from passing from said one or more fluid containing compartments to said one or more lens containing compartments.

5. An apparatus as described in claim 4 further comprising a granular reactive agent connected to said one or more screens, such that dispersal of said one or more lens care solutions from said one or more balloons will contact said reactive agent prior to passing through said one or more ports and into said one or more lens containing compartments.

6. An apparatus as described in claim 5, wherein said reactive agent comprises a quantity of platinum black catalyst.

7. An apparatus as described in claim 1, wherein said lens care solutions comprise a quantity of sodium chloride and hydrogen peroxide.

8. An apparatus as described in claim 1 further comprising flexible closure means connected to said envelope for selectively opening and hermetically sealing said one or more lens containing compartments.

9. An apparatus as described in claim 8, wherein said closure means comprising a tongue and groove closure connected to said envelope adjacent to said open end thereof.

10. Apparatus as described in claim 1 further comprising one or more reactive filaments contained within selected ones of said one or more fluid containing compartments proximate selected ones of said one or more balloons such that dispersal of said one or more lens care solutions from said one or more balloons will contact said one or more reactive filaments prior to passing through said one or more ports and into said one or more lens containing compartments.

11. An apparatus as described in claim 10, wherein said lens care solutions comprise a quantity of sodium chloride and hydrogen peroxide.

12. An apparatus as described in claim 10, wherein said reactive filaments comprises a quantity of platinum black catalyst.

13. A disposable contact lens containing and cleaning apparatus comprising:

(a) flexible and transparent lens containing means for containing one or more contact lenses;

(b) flexible and transparent solution containing means connected to said lens containing means for containing a quantity of lens care solution;

(c) means formed by said lens containing means and contained within said solution containing means for selectively dispensing said lens care solution within said lens containing means; and (d) means contained within said solution containing means in isolation from said lens care solution for selectively reacting with said lens care solution to facilitate a predetermined chemical alteration thereof prior to dispersal of said lens care solution within said lens containing means.

14. Apparatus as described in claim 13 wherein said lens containing means comprises:

(a) a flexible and transparent lens envelope having an open end and a closed end defined by a horizontal seam formed by said lens envelope opposite said open end;

(b) a vertical seam formed by said lens envelope and extending perpendicularly from said horizontal seam to said open end to divide said lens envelope into a right lens containing compartment and a left lens containing compartment; and (c) flexible closure means connected to said lens envelope adjacent said open end thereof for selectively opening and hermetically sealing said left and right lens containing compartments.

15. An apparatus as described in claim 14 wherein said solution containing means comprises a flexible and transparent fluid containing envelope connected to said horizontal seam.

16. An apparatus as described in claim 15 wherein said dispensing means comprises:

(a) a flexible and transparent balloon contained within said fluid containing envelope and having said quantity of lens care solution contained therein; and (b) a plurality of ports formed by said horizontal seam to facilitate communication between said fluid containing envelope and said left and right lens containing compartments such that selective exertion of manual pressure on said fluid containing envelope will burst said balloon and disperse said lens care solution therefrom and through said ports and within said left and right lens containing compartments.

17. An apparatus as described in claim 16 wherein said reactive means comprises:

(a) a screen connected to and contained within said fluid containing envelope adjacent said ports for preventing debris having a predetermined granular size from passing from said second envelope through said ports; and (b) a granular reactive agent connected to said screen such that selective dispersal of said lens care solution from said balloon will contact said reactive agent prior to passing through said one or more ports and into said left and right lens containing compartments.

18. An apparatus as described in claim 17 wherein said granular reactive agent comprises a quantity of platinum black catalyst.

19. An apparatus as described in claim 16 wherein said reactive means comprises a platinum black catalyst filament contained within said fluid containing envelope.

* * * * *